US010641258B2

(12) United States Patent
Liu

(10) Patent No.: US 10,641,258 B2
(45) Date of Patent: May 5, 2020

(54) INFLATING DEVICE

(71) Applicant: Zhiming Liu, Guangdong (CN)

(72) Inventor: Zhiming Liu, Guangdong (CN)

( * ) Notice: Subject to any disclaimer, the term of this patent is extended or adjusted under 35 U.S.C. 154(b) by 219 days.

(21) Appl. No.: 15/036,049

(22) PCT Filed: Oct. 28, 2014

(86) PCT No.: PCT/CN2014/000952
§ 371 (c)(1),
(2) Date: May 11, 2016

(87) PCT Pub. No.: WO2016/054761
PCT Pub. Date: Apr. 14, 2016

(65) Prior Publication Data

US 2017/0107980 A1 Apr. 20, 2017

(30) Foreign Application Priority Data

Oct. 9, 2014 (CN) ..... 2014 2 0581671 U

(51) Int. Cl.
*F04B 33/00* (2006.01)
*F04B 45/00* (2006.01)
(Continued)

(52) U.S. Cl.
CPC ..... *F04B 33/00* (2013.01); *F04B 39/10* (2013.01); *F04B 45/00* (2013.01); *F04B 45/02* (2013.01); *F04B 45/04* (2013.01); *F04B 53/1025* (2013.01)

(58) Field of Classification Search
CPC ..... F04B 33/00; F04B 35/06; F04B 37/10; F04B 39/10; F04B 39/102; F04B 45/00;
(Continued)

(56) References Cited

U.S. PATENT DOCUMENTS 1,779,421 A * 10/1930 Cox ..... F16K 15/063 137/515.3
3,068,494 A * 12/1962 Pinkwater ..... A47C 27/081 417/441
(Continued)

FOREIGN PATENT DOCUMENTS

CN 201069009 Y 6/2008
CN 104279137 A 1/2015
CN 204175545 U 2/2015

OTHER PUBLICATIONS

International Search Report for International application No. PCT/CN20141000952, dated Jul. 9, 2015.

*Primary Examiner* — Bryan M Lettman
*Assistant Examiner* — Charles W Nichols
(74) *Attorney, Agent, or Firm* — Shimokaji IP

(57) ABSTRACT

An inflating device comprises a valve body and a gasbag, the valve body being provided with a gas inlet, a gas outlet and a gas storage chamber; the gas inlet has a gas intake valve device provided therein, and the gas outlet has a gas exhaust valve device provided therein; the gas storage chamber is communicated with the gasbag; and the gas inlet is communicated with the gas outlet through a chamber body of the valve body, and the gas storage chamber is communicated with the chamber body. In the invention, gas can be fed into an inflatable product by continually pressing with hands, without requiring electricity or blowing with mouth. The inflating device of the invention is convenient to operate, clean and sanitary. The inflating device of the invention has a small volume and is thus convenient to carry.

6 Claims, 6 Drawing Sheets

(51) Int. Cl.

| | |
|---|---|
| ***F04B 45/02*** | (2006.01) |
| ***F04B 53/10*** | (2006.01) |
| ***F04B 39/10*** | (2006.01) |
| ***F04B 45/04*** | (2006.01) |

(58) Field of Classification Search

CPC ..... F04B 45/02; F04B 45/0336; F04B 45/06; F04B 49/22; F04B 49/225; F04B 53/102–1035; F04B 53/1085; F04B 53/1087; F04B 53/1092; F04B 53/1095; F15B 15/19; F16K 15/185; F16K 15/207; F16K 17/168; F16K 15/02; F16K 15/063; F16K 15/14; F16K 17/30

USPC ..... 137/512, 540, 541, 542, 543.15

See application file for complete search history.

(56) References Cited

U.S. PATENT DOCUMENTS

| | | | | |
|---|---|---|---|---|
| 5,226,793 | A * | 7/1993 | Stovall | F04B 33/00 417/437 |
| 6,923,202 | B2 * | 8/2005 | Enerson | F16K 15/026 137/271 |
| 2003/0000577 | A1 * | 1/2003 | Noll | E03B 7/077 137/454.2 |
| 2007/0071623 | A1 * | 3/2007 | Chang | F04B 33/00 417/480 |
| 2009/0084447 | A1 * | 4/2009 | Henkel | A61F 2/26 137/12 |
| 2011/0293454 | A1 | 12/2011 | Yang | |
| 2014/0241922 | A1 | 8/2014 | Yang | |

* cited by examiner

INFLATING DEVICE

FIELD OF THE INVENTION

The invention relates to an inflating device, and in particular to a device which is simple in structure and convenient to use and can realize manual inflation without requiring other tools.

BACKGROUND OF THE INVENTION

At present, there are many commercially available inflatable products, for example, inflatable toys, swim rings, inflatable pillows, inflatable mattresses and the like. For many small products, for example, inflatable toys and swim rings and the like, blowing with mouth is generally used. While for some large products, for example, inflatable mattresses, an electric inflating device is generally used. For products requiring blowing with mouth, it is not only labor-consuming but also unsanitary. Especially for some inflatable products used in public occasions, for example, inflatable pillows used in coaches, it is very unsanitary to blow with mouth while troublesome if they are inflated by other special instruments. Gas supply devices employing an electric compressor have a great volume and are inconvenient to use, and must be provided with a power supply. This results in great limitation to the inflation of products.

SUMMARY OF THE INVENTION

A technical problem required to be solved by the invention is to provide an inflating device, which has a small volume and a simple structure, is convenient to use without requiring any power supply, and allows for a simple deflating operation.

The invention may employ the following technical solutions.

An inflating device is provided, including a valve body and a gasbag, the valve body being provided with a gas inlet, a gas outlet and a gas storage chamber; the gas inlet has a gas intake valve device provided therein, and the gas outlet has a gas exhaust valve device provided therein; the gas storage chamber is communicated with the gasbag; and the gas inlet is communicated with the gas outlet through a chamber body of the valve body, and the gas storage chamber is communicated with the chamber body.

The invention may further make the following improvement to solve the problem:

As a further improvement, the gas exhaust valve device includes a gas exhaust valve base having a gas exhaust valve through hole provided therein, and a gas exhaust valve ring is provided in the gas exhaust valve through hole; and the gas exhaust valve ring is connected to a wall of the gas exhaust valve through hole by at least two gas exhaust valve supporting bars, and the gas exhaust valve base, the gas exhaust valve ring and the gas exhaust valve supporting bars are integrated.

A gas exhaust valve core passes through and is axially moveable in an inner hole of the gas exhaust valve ring; an annular protrusion, which is larger than the inner hole of the gas exhaust valve ring and radially faces outward, is provided on an outer end of the gas exhaust valve core, an inner end of the gas exhaust valve core is connected with a gas exhaust valve raised-bonnet which is larger than the inner hole of the gas exhaust valve ring, and the gas exhaust valve ring is positioned between the annular protrusion and the gas exhaust valve raised-bonnet; a gas exhaust valve spring is provided between the gas exhaust valve raised-bonnet and the gas exhaust valve ring, and the inner end of the gas exhaust valve core passes through the gas exhaust valve spring; and the outer end of the gas exhaust valve core faces outside the valve body, and the inner end of the gas exhaust valve core faces the chamber body of the valve body. As a further improvement, the outer end of the gas exhaust valve core is connected with a gas exhaust valve seal, an annular slope is provided at an outer end of the gas exhaust valve through hole, the shape and size of the annular slope are matched with those of the gas exhaust valve seal, and the gas exhaust valve spring enables the gas exhaust valve seal to seal the gas exhaust valve through hole after coming into close contact with the annular slope.

As a further improvement, the gas intake valve device includes a gas intake valve base having a gas intake valve through hole provided therein, and a gas intake valve ring is provided in the gas intake valve through hole; and the gas intake valve ring is connected to a wall of the gas intake valve through hole by at least two gas intake valve supporting bars, and the gas intake valve base, the gas intake valve ring and the gas intake valve supporting bars are integrated.

A gas intake valve core passes through and is axially movable in an inner hole of the gas intake valve ring; an annular protrusion, which is larger than the inner hole of the gas intake valve ring and radially faces outward, is provided on an outer end of the gas intake valve core, an inner end of the gas intake valve core is connected with a gas intake valve raised-bonnet which is larger than the inner hole of the gas intake valve ring, and the gas intake valve ring is positioned between the annular protrusion and the gas intake valve bonnet; a gas intake valve spring is provided between the gas intake valve raised-bonnet and the gas intake valve ring, and the inner end of the gas intake valve core passes through the gas intake valve spring; and the outer end of the gas intake valve core faces the chamber body of the valve body, and the inner end of the gas intake valve core faces outside the valve body.

As a further improvement, the outer end of the gas intake valve core is connected with a gas intake valve seal, an annular slope is provided at an outer end of the gas intake valve through hole, the shape and size of the annular slope are matched with those of the gas intake valve seal, and the gas intake valve spring enables the gas intake valve seal to seal the gas intake valve through hole after coming into close contact with the annular slope; and the outer end of the gas intake valve through hole faces the chamber body of the valve body, and the inner end of the gas intake valve through hole faces outside the valve body.

As a further improvement, the gas exhaust valve base is provided with a gas exhaust valve plug-in member, the gas intake valve base is provided with a gas intake valve plug-in member corresponding to and being coordinated with the gas exhaust valve plug-in member, and the gas exhaust valve plug-in member is in plug-in connection to the gas intake valve plug-in member.

As a further improvement, the gas exhaust valve through hole and the gas intake valve through hole share one axis; there is a gap between the gas exhaust valve raised-bonnet and the gas intake valve seal, the gas intake valve core can move the gas exhaust valve core through the gas intake valve seal to open the gas outlet when the gas intake valve core is pressed in a direction from the gas intake valve through hole to the chamber body of the valve body.

As a further improvement, an extension portion is provided on an inner side of the gas exhaust valve seal, and the extension portion is an elastomer; one end, far away from the gas exhaust value seal, of the extension portion is a distal end of the extension portion; and the distal end has a bump radially facing outward, the bump is positioned within a slot of the gas exhaust valve core after passing through the inner hole of the gas exhaust valve core, and the bump is larger than the inner hole of the gas exhaust valve core.

As a further improvement, an extension portion is provided on an inner side of the gas intake valve seal, and the extension portion is an elastomer; one end, far away from the gas inlet value seal, of the extension portion is a distal end of the extension portion; and the distal end has a bump radially facing outward, the bump is positioned within a slot of the gas intake valve core after passing through the inner hole of the gas intake valve core, and the bump is larger than the inner hole of the gas intake valve core.

As a further improvement, the valve body is constituted of a casing and a side bonnet connected to each other, the gas outlet is arranged within the casing, and the gas inlet is arranged on the side bonnet. As a further improvement, the gas exhaust valve base is provided with a round step, which is positioned within the casing and closely coordinated with an inner wall of the casing.

As a further improvement, the gasbag is positioned beside the valve body, and the gasbag is positioned beside a central axis of the gas outlet and a central axis of the gas inlet.

As a further improvement, the inner end of the gas intake valve through hole is detachably connected with a spring fixed lid.

The technical solutions have the following technical effects:

1. In the invention, gas may be fed into an inflatable product by continually pressing with hands, without requiring electricity or blowing with mouth. The inflating device of the invention is convenient to operate, clean and sanitary. The invention has a small volume and is thus convenient to carry. The operation will not require any power supply.

2. The inflating device of the invention has a simple structure and a small volume. The deflating operation is also easy and simple.

DETAILED DESCRIPTION OF THE PREFERRED EMBODIMENTS

Figure 1:
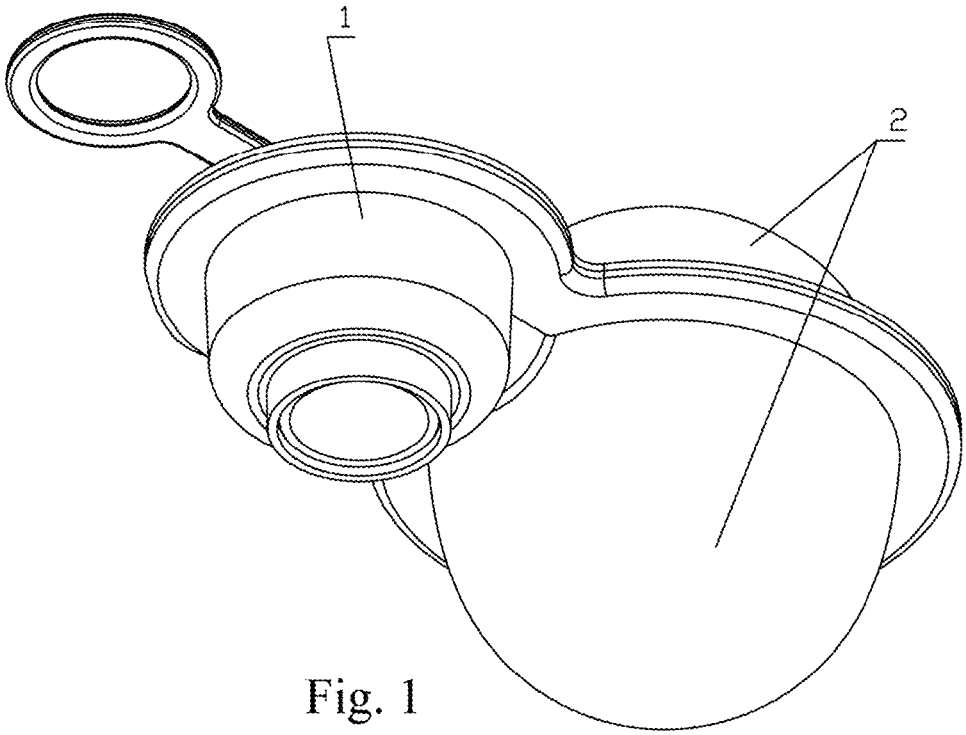
FIG. 1 is a schematic structure diagram of the invention.
Figure 2:
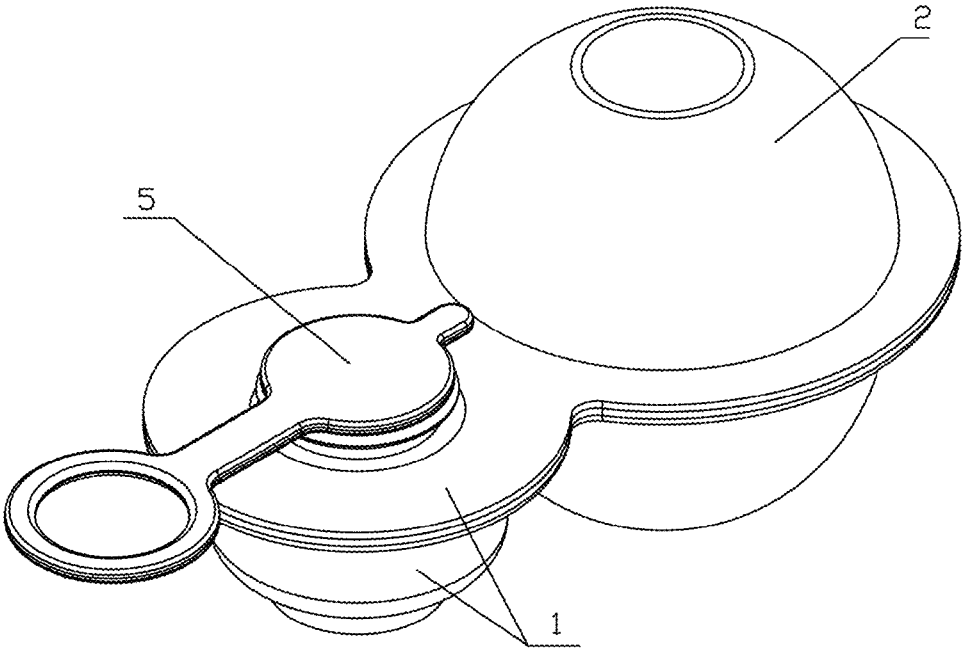
FIG. 2 is a schematic diagram of the invention viewed from another angle of view.
Figure 3:
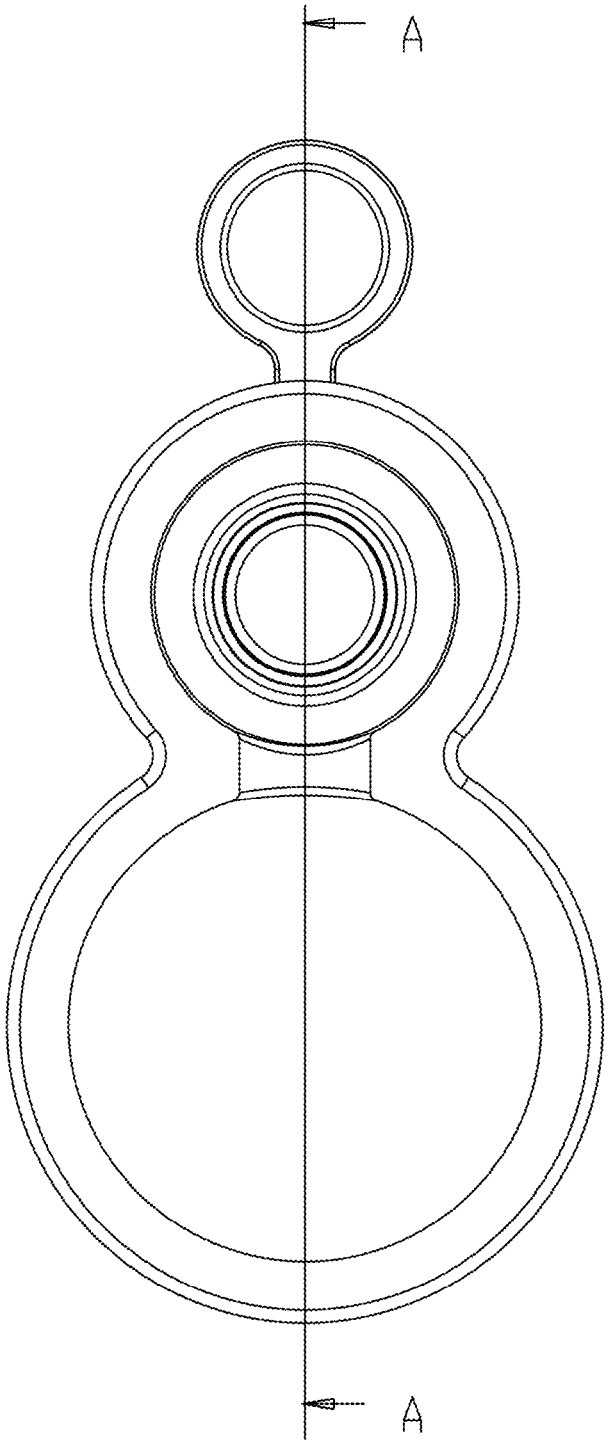
FIG. 3 is a schematic diagram of the invention when viewed from still another angle of view.
Figure 4:
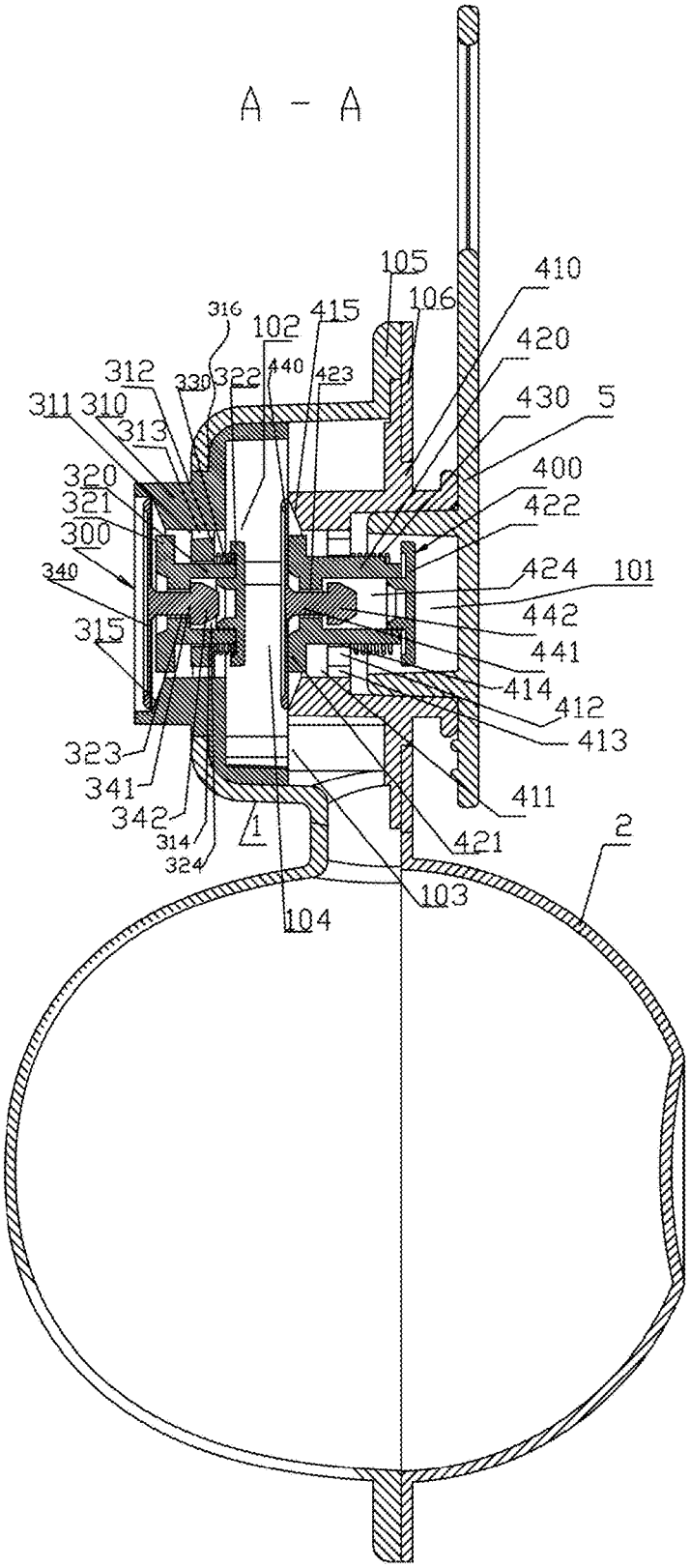
FIG. 4 is a schematic diagram along a line A-A of FIG. 3.
Figure 5:
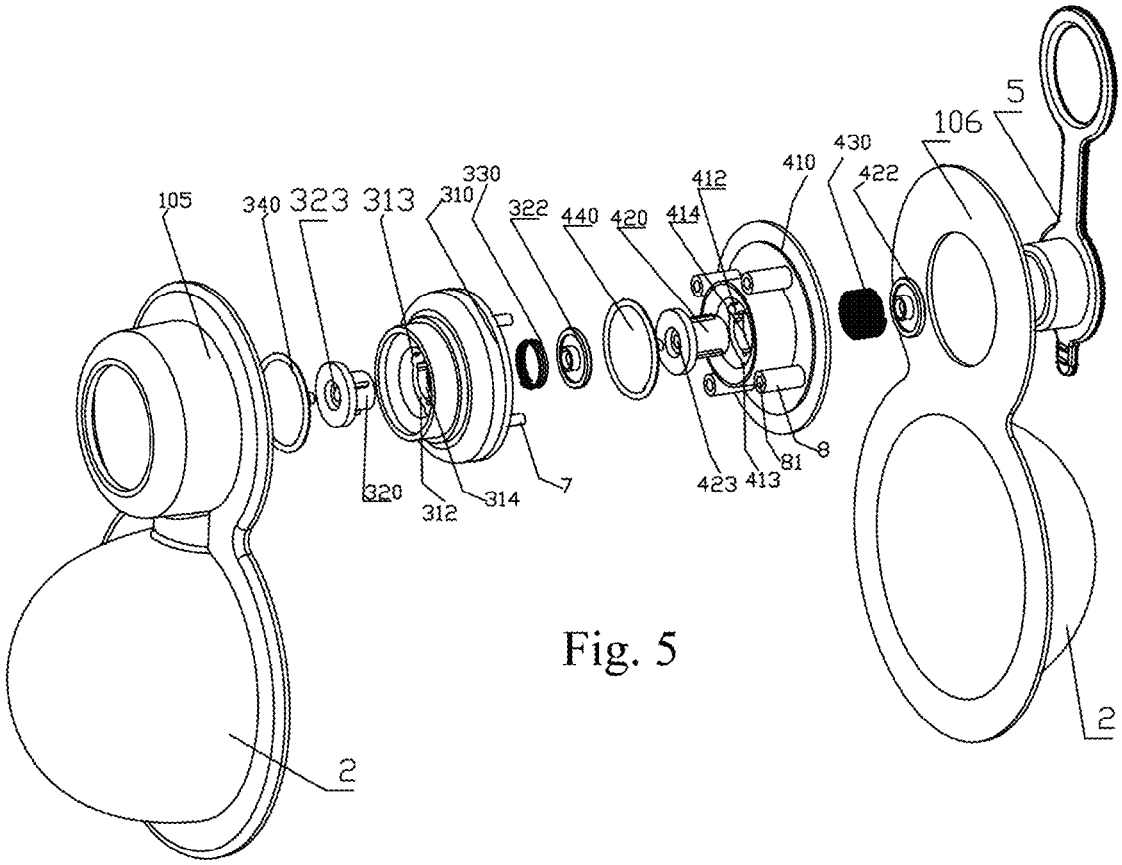
FIG. 5 is an exploded diagram of components.
Figure 6:
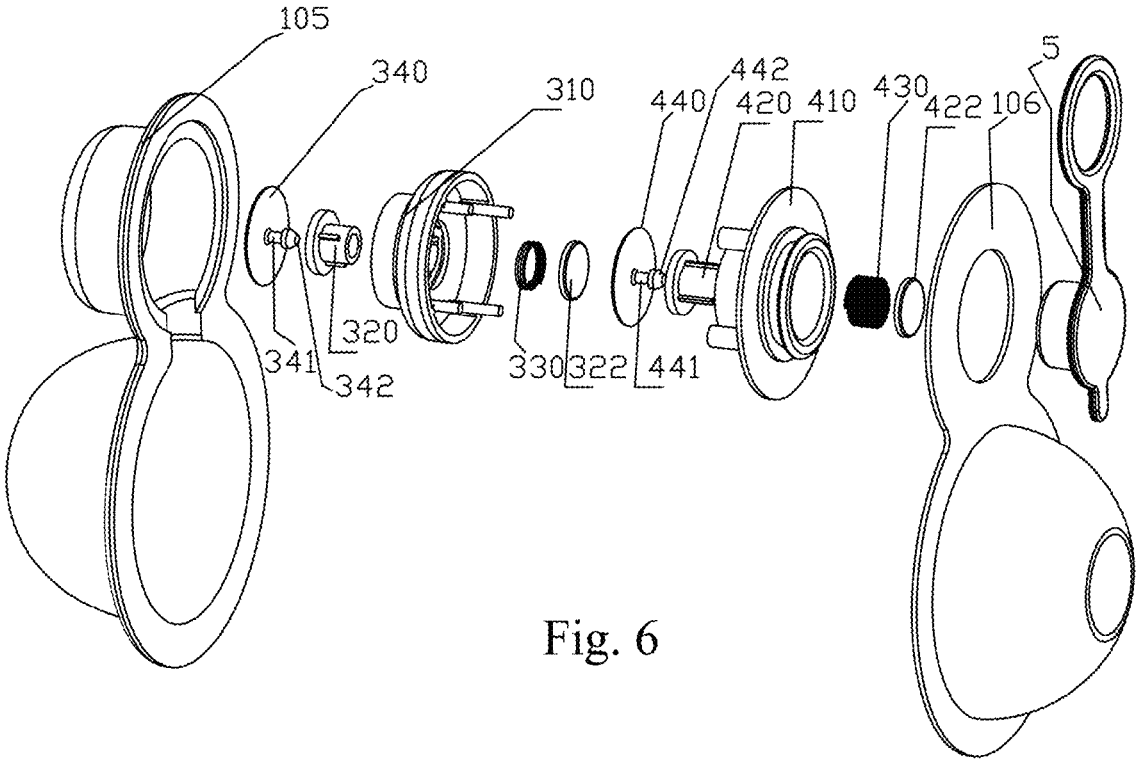
FIG. 6 is an exploded diagram of the components when viewed from another angle of view.

The invention will be described below in detail by a specific embodiment.

Embodiment

As shown in FIGS. 1, 2, 3, 4, 5, 6, 7 and 8, an inflating device is provided, including a valve body 1 and a gasbag 2, the valve body 1 being provided with a gas inlet 101, a gas outlet 102 and a gas storage chamber 103; the gas inlet 101 has a gas intake valve device 400 provided therein, and the gas outlet 102 has a gas exhaust valve device 300 provided therein; the gas storage chamber 103 is communicated with the gasbag 2. The gas inlet 101 is communicated with the gas outlet 102 through a chamber body 104 of the valve body 1, and the gas storage chamber 103 is communicated with the chamber body 104. In this embodiment, the gasbag 2 is a sphere when in a natural state.

The gas exhaust valve device 300 includes a gas exhaust valve base 310 having a gas exhaust valve through hole 311 provided therein, and a gas exhaust valve ring 312 is provided in the gas exhaust valve through hole 311; the gas exhaust valve ring 312 is connected to a wall of the gas exhaust valve through hole 311 by at least two gas exhaust valve supporting bars 313, and the gas exhaust valve base 310, the gas exhaust valve ring 312 and the gas exhaust valve supporting bars 313 are integrated. In this embodiment, there are three gas exhaust valve supporting bars 313. Of course, there may be two or more gas exhaust valve supporting bars 313.

The gas exhaust valve core 320 passes through and may be axially moveable in an inner hole 314 of the gas exhaust valve ring 312. An annular protrusion 312, which is larger than the inner hole 314 of the gas exhaust valve ring and radially faces outward, is provided on an outer end of the gas exhaust valve core 320, an inner end of the gas exhaust valve core 320 is connected with a gas exhaust valve raised-bonnet 322 which is larger than the inner hole 314 of the gas exhaust valve ring 312, and the gas exhaust valve ring 312 is positioned between the annular protrusion 321 and the gas exhaust valve raised-bonnet 322; a gas exhaust valve spring 330 is provided between the gas exhaust valve raised-bonnet 322 and the gas exhaust valve ring 312, and the inner end of the gas exhaust valve core 320 passes through the gas exhaust valve spring 330; and the outer end of the gas exhaust valve core 320 faces outside the valve body 1, and the inner end of the gas exhaust valve core 320 faces the chamber body 104 of the valve body 1.

The outer end of the gas exhaust valve core 320 is connected with a gas exhaust valve seal 340, an annular slope 315 is provided at an outer end of the gas exhaust valve through hole 311, the shape and size of the annular slope 315 are matched with those of the gas exhaust valve seal 340, and the gas exhaust valve spring 330 enables the gas exhaust valve seal 340 to seal the gas exhaust valve through hole 311 after coming into close contact with the annular slope 315. In this embodiment, the gas exhaust valve seal is, just like a conventional seal, made of elastic plastic.

The gas intake valve device 400 includes a gas intake valve base 410 having a gas intake valve through hole 411 provided therein, and a gas intake valve ring 412 is provided in the gas intake valve through hole 411; and the gas intake valve ring 412 is connected to a wall of the gas intake valve through hole 411 by at least two gas intake valve supporting bars 413, and the gas intake valve base 410, the gas intake valve ring 412 and the gas intake valve supporting bars 413 are integrated.

A gas intake valve core 420 passes through and may be axially movable in an inner hole 414 of the gas intake valve ring 412; an annular protrusion 421, which is larger than the inner hole 414 of the gas intake valve ring 412 and radially faces outward, is provided on an outer end of the gas intake valve core 420, an inner end of the gas intake valve core 420 is connected with a gas intake valve raised-bonnet 422 which is larger than the inner hole 414 of the gas intake valve ring 412, and the gas intake valve ring 412 is positioned between the annular protrusion 421 and the gas intake valve bonnet 422. A gas intake valve spring 430 is provided between the gas intake valve raised-bonnet 422 and the gas intake valve ring 412, and the inner end of the gas intake valve core 420 passes through the gas intake valve spring 430; and the outer end of the gas intake valve core 420 faces the chamber body 104 of the valve body, and the inner end of the gas intake valve core 420 faces outside the valve body 1.

The outer end of the gas intake valve core 420 is connected with a gas intake valve seal 440, an annular slope 415 is provided at an outer end of the gas intake valve through hole 411, the shape and size of the annular slope 415 are matched with those of the gas intake valve seal 440, and the gas intake valve spring enables the gas intake valve seal 440 to seal the gas intake valve through hole 411 after coming into close contact with the annular slope 415; and the outer end of the gas intake valve through hole 411 faces the chamber body 104 of the valve body 1, and the inner end of the gas intake valve through hole 411 faces outside the valve body 1. In this embodiment, the gas intake valve seal is, just like a conventional seal, made of plastic.

The inner end of the gas intake valve through hole 411 is connected with a lid 5 which is used for preventing the gas within an object to be inflated from leaking.

The gas exhaust valve through hole 311 and the gas intake valve through hole 411 share one axis; there is a gap between the gas exhaust valve raised-bonnet 322 and the gas intake valve seal 440, the gas intake valve core 420 can move the gas exhaust valve core 320 through the gas intake valve seal 440 to open the gas outlet when the gas intake valve core 420 is pressed in a direction from the gas intake valve through hole 411 to the chamber body of the valve body.

The valve body 1 is constituted of a casing 105 and a side bonnet 106 connected to each other, the gas outlet 102 is arranged within the casing 105, and the gas inlet 101 is arranged on the side bonnet 106.

The gas exhaust valve base 310 is provided with a round step 316 which is positioned within the casing 105 and closely fitted with an inner wall of the casing 105.

The gas exhaust valve base 310 is provided with a gas exhaust valve plug-in member 7, the gas intake valve base 320 is provided with a gas intake valve plug-in member 8 corresponding to and being coordinated with the gas exhaust valve plug-in member 7, and the gas exhaust valve plug-in member is in plug-in connection to the gas intake valve plug-in member 8; and a hole 81 is formed on the gas intake valve plug-in member 8, and the gas exhaust valve plug-in member is inserted into the hole 81 of the gas intake valve plug-in member to realize the plug-in connection. In this way, it is conducive to positioning and fixing the two bases.

As a further improvement, an extension portion 341 is provided on an inner side of the gas exhaust valve seal 340, and the extension portion 341 is an elastomer; one end, far away from the gas exhaust value seal 340, of the extension portion 341 is a distal end of the extension portion 341; and the distal end has a bump 342 radially facing outward, the bump 342 is positioned within a slot 324 of the gas exhaust valve core after passing through the inner hole 323 of the gas exhaust valve core 320, and the bump 342 is larger than the inner hole 323 of the gas exhaust valve core 320. With such a structure, the connection between the gas exhaust valve seal and the gas exhaust valve core is realized, and the assembly and disassembly are convenient and fast.

An extension portion 441 is provided on an inner side of the gas intake valve seal 440, and the extension portion 441 is an elastomer; one end, far away from the gas intake value seal 440, of the extension portion 441 is a distal end of the extension portion 441; and the distal end has a bump 442 radially facing outward, the bump 442 is positioned within a slot 424 of the gas intake valve core after passing through the inner hole 423 of the gas intake valve core 420, and the bump 442 is larger than the inner hole 423 of the gas intake valve core 423. With such a structure, the connection between the gas intake valve seal and the gas intake valve core is realized, and the assembly and disassembly are convenient and fast.

The gasbag 2 is positioned beside the valve body 1, and the gasbag 2 is positioned beside a central axis of the gas outlet 102 and a central axis of the gas inlet 101.

Figure 7:
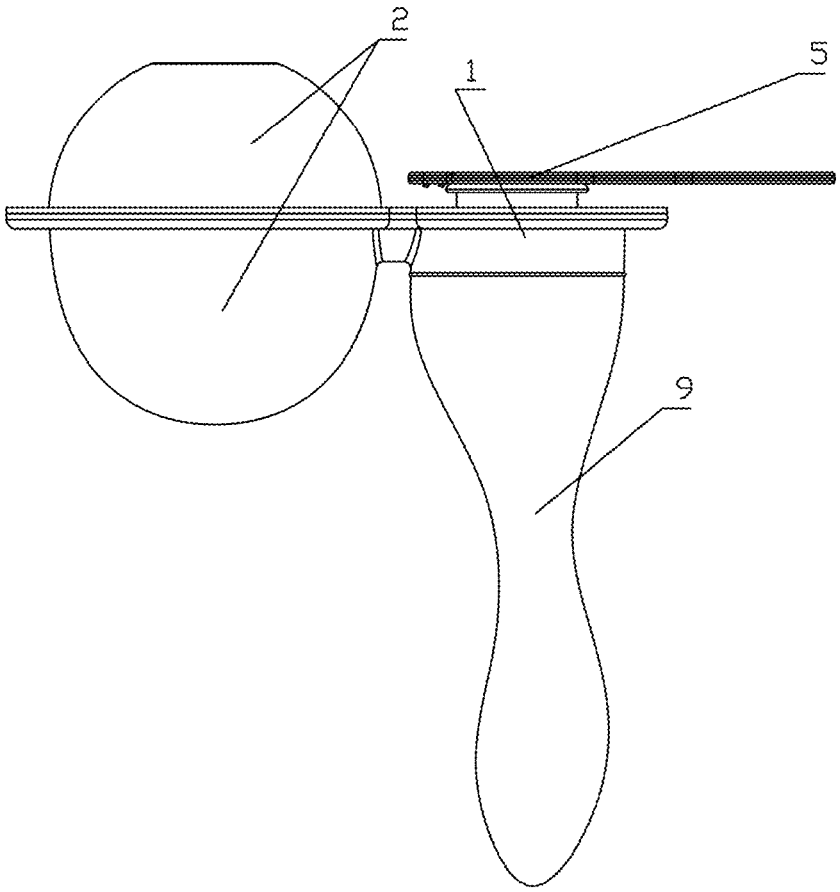
FIG. 7 is a schematic diagram of a use state.
Figure 8:
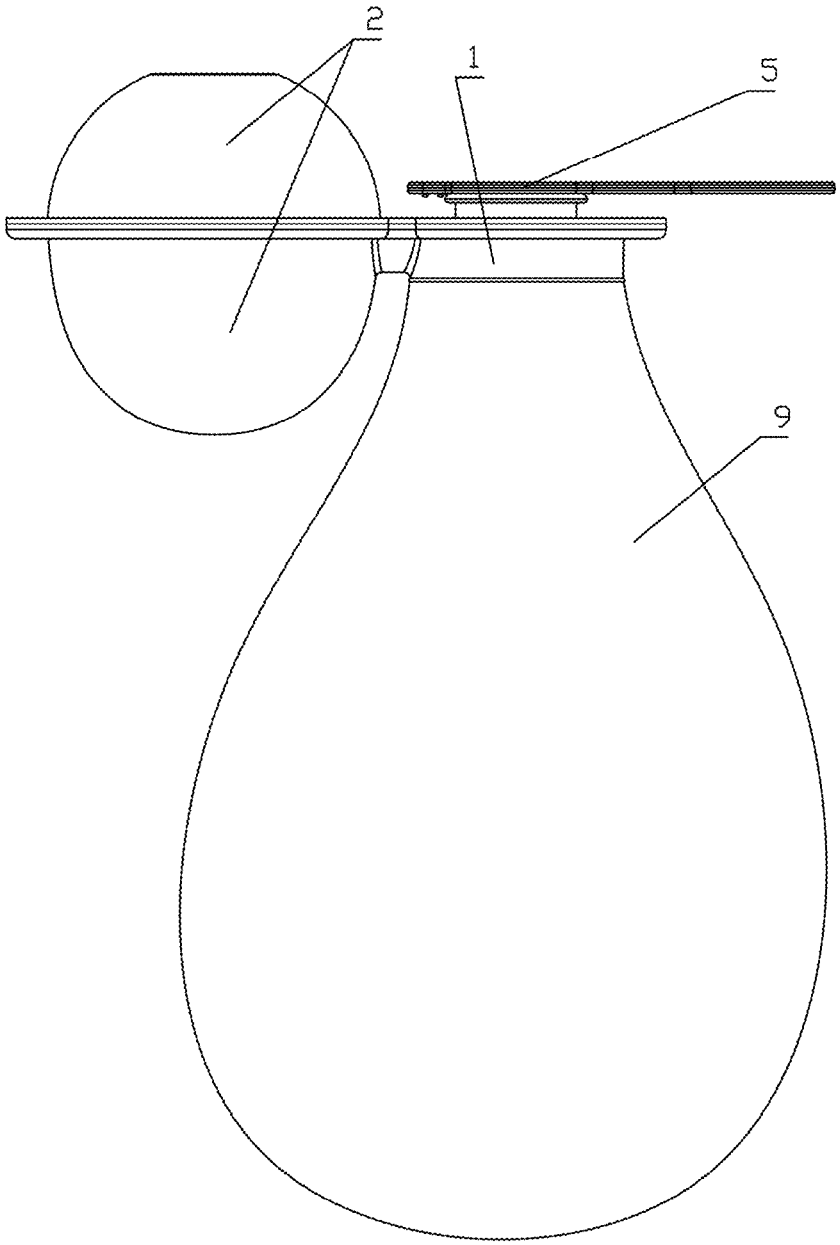
FIG. 8 is a schematic diagram of another use state.

FIG. 7 and FIG. 8 are schematic diagrams of a use state when gas is being fed. The object 9 is an object to be inflated. During the use, the gas exhaust valve base 310 is connected to the object 9 to be inflated in a sealed manner.

During the inflation, the lid 5 may be opened, the gasbag 2 is pressed and the gas pressure inside the chamber body 104 is thus increased, and the gas intake valve seal 440 firmly presses the annular slope 415 due to the gas pressure, so that the gas inlet 101 is kept closed; and the gas pressure acts on the gas exhaust valve spring fixing lid 322, so that the body of the gas exhaust valve core 320 moves outward against the elasticity of the gas exhaust valve spring 330. In this way, a gap is formed between the gas exhaust valve seal 340 and the annular slope 315, and the gas in the gasbag 2 is fed into the object to be inflated from the gap after passing through the gas storage chamber 103, the chamber body 104 and the gas outlet 102. The gasbag 2 expands outward when it is released. At this time, the negative pressure effect occurs, the gas exhaust valve seal 340 and the annular slope 315 are firmly closed, and the gas outlet 102 is closed; and the gas intake valve core 420 moves towards the gas exhaust valve core 320 against the elasticity of the gas intake valve spring 430 due to the ambient pressure. At this time, a gap is formed between the gas intake valve seal 440 and the annular slop 415, and the external gas enters the chamber body 104 from the gas inlet 101 and then enters the gasbag 2 after passing through the gas storage chamber 103 until the gasbag 2 expands to the natural state. Then, the gasbag 2 is pressed again, and the gas will be fed into the object to be inflated. Gas is continuously fed by repeating this process. The inflating device of the invention has a small volume and a simple structure, and is convenient to use. The manual operation is easy.

To deflate an object, the gas intake valve spring fixing lid 422 is pressed, so that the gas intake valve core moves towards the gas exhaust valve core 320 against the elasticity of the gas intake valve spring 430. At this time, a gap is formed between the gas intake valve seal 440 and the annular slope 415. Meanwhile, the gas intake valve seal 440 bears against the gas exhaust valve spring fixing lid 322, so that the gas exhaust valve core 320 moves outward against the elasticity of the gas exhaust valve spring 330. In this way, a gap is formed between the gas exhaust valve seal 340 and the annular slope 315, and the gas in the object to be deflated comes out from the gap after passing through the gas outlet and the gas inlet, the deflating is thus realized. The deflating is convenient, the manual control is simple, the manufacture is easy, and it is convenient to adjust the gas pressure of inflatable products and to deflate the inflatable products.

What described above is merely a preferred embodiment of the invention and not intended to limit the invention, and any modifications, equivalent replacements and improvements made within the spirit and principle of the invention should fall into the protection scope of the invention.

What is claimed is:

1. An inflating device, comprising a valve body and a gasbag, the valve body being provided with a gas inlet, a gas outlet and a gas storage chamber; wherein the gas inlet has a gas intake valve device provided therein, and the gas outlet has a gas exhaust valve device provided therein; the gas storage chamber is communicated with the gasbag; the gas inlet is communicated with the gas outlet through a chamber body of the valve body, and the gas storage chamber is communicated with the chamber body; the valve body comprises a casing and a side bonnet connected to each other, the gas outlet is arranged within the casing, and the gas inlet is arranged on the side bonnet; and the gas intake valve device comprises a gas intake valve base having a gas intake valve through hole, a gas intake valve seal is provided on the outer end of the gas intake valve through hole, and the inner end of the gas intake valve through hole is connected with a lid;

a gas intake valve ring is provided in the gas intake valve through hole, and the gas intake valve ring is connected to a wall of the gas intake valve through hole by at least two gas intake valve supporting bars, and the gas intake valve base, the gas intake valve ring and the gas intake valve supporting bars are integrated;

a gas intake valve core passes through and is axially movable in an inner hole of the gas intake valve ring; an annular protrusion, which is larger than the inner hole of the gas intake valve ring and radially faces outward, is provided on an outer end of the gas intake valve core, an inner end of the gas intake valve core is connected with a gas intake valve raised-bonnet which is larger than the inner hole of the gas intake valve ring, and the gas intake valve ring is positioned between the annular protrusion and the gas intake valve bonnet; a gas intake valve spring is provided between the gas intake valve raised-bonnet and the gas intake valve ring, and the inner end of the gas intake valve core passes through the gas intake valve spring; and the outer end of the gas intake valve core faces the chamber body of the valve body, and the inner end of the gas intake valve core faces outside the valve body;

the outer end of the gas intake valve core is connected with the gas intake valve seal, an annular slope is provided at an outer end of the gas intake valve through hole, the shape and size of the annular slope are matched with those of the gas intake valve seal, and the gas intake valve spring enables the gas intake valve seal to seal the gas intake valve through hole after coming into close contact with the annular slope; and the outer end of the gas intake valve through hole faces the chamber body of the valve body, and the inner end of the gas intake valve through hole faces outside the valve body;

an extension portion is provided on an inner side of the gas intake valve seal, and the extension portion is an elastomer; one end, far away from the gas inlet value seal, of the extension portion is a distal end of the extension portion; and the distal end has a bump radially facing outward, the bump is positioned within a slot of the gas intake valve core after passing through the inner hole of the gas intake valve core, and the bump is larger than the inner hole of the gas intake valve core.

2. The inflating device according to claim 1, wherein the gas exhaust valve device comprises a gas exhaust valve base having a gas exhaust valve through hole provided therein, and a gas exhaust valve ring is provided in the gas exhaust valve through hole; and the gas exhaust valve ring is connected to a wall of the gas exhaust valve through hole by at least two gas exhaust valve supporting bars, and the gas exhaust valve base, the gas exhaust valve ring and the gas exhaust valve supporting bars are integrated;

a gas exhaust valve core passes through and is axially moveable in an inner hole of the gas exhaust valve ring; an annular protrusion, which is larger than the inner hole of the gas exhaust valve ring and radially faces outward, is provided on an outer end of the gas exhaust valve core, an inner end of the gas exhaust valve core is connected with a gas exhaust valve raised-bonnet which is larger than the inner hole of the gas exhaust valve ring, and the gas exhaust valve ring is positioned between the annular protrusion and the gas exhaust valve bonnet; a gas exhaust valve spring is provided between the gas exhaust valve raised-bonnet and the gas exhaust valve ring, and the inner end of the gas exhaust valve core passes through the gas exhaust valve spring; and the outer end of the gas exhaust valve core faces outside the valve body, and the inner end of the gas exhaust valve core faces the chamber body of the valve body.

3. The inflating device according to claim 2, wherein the outer end of the gas exhaust valve core is connected with a gas exhaust valve seal, an annular slope is provided at an outer end of the gas exhaust valve through hole, the shape and size of the annular slope are matched with those of the gas exhaust valve seal, and the gas exhaust valve spring enables the gas exhaust valve seal to seal the gas exhaust valve through hole after coming into close contact with the annular slope.

4. The inflating device according to claim 2, wherein the gas exhaust valve base is provided with a gas exhaust valve plug-in member, the gas intake valve base is provided with a gas intake valve plug-in member corresponding to and being coordinated with the gas exhaust valve plug-in member, and the gas exhaust valve plug-in member is in plug-in connection to the gas intake valve plug-in member.

5. The inflating device according to claim 1 wherein the gas exhaust valve through hole and the gas intake valve through hole share one axis; there is a gap between the gas exhaust valve raised-bonnet and the gas intake valve seal, the gas intake valve core can move the gas exhaust valve core through the gas intake valve seal to open the gas outlet when the gas intake valve core is pressed in a direction from the gas intake valve through hole to the chamber body of the valve body.

6. The inflating device according to claim 3, wherein an extension portion is provided on an inner side of the gas exhaust valve seal, and the extension portion is an elastomer; one end, far away from the gas exhaust value seal, of the extension portion is a distal end of the extension portion; and the distal end has a bump radially facing outward, the bump is positioned within a slot of the gas exhaust valve core after passing through the inner hole of the gas exhaust valve core, and the bump is larger than the inner hole of the gas exhaust valve core.

* * * * *